US006994583B1

(12) United States Patent
Chi-Te

(10) Patent No.: US 6,994,583 B1
(45) **Date of Patent: *Feb. 7, 2006**

(54) CONNECTOR

(75) Inventor: Kuan Chi-Te, Shulin (TW)

(73) Assignee: L&K Precision Technology Co., Ltd., Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/895,054

(22) Filed: Jul. 21, 2004

(51) Int. Cl.
*H01R 4/24* (2006.01)

(52) U.S. Cl. ..... 439/404; 439/417

(58) Field of Classification Search ..... 439/404, 439/405, 417, 422, 498, 497, 499
See application file for complete search history.

(56) References Cited

U.S. PATENT DOCUMENTS 5,865,642 A * 2/1999 Rugg ..... 439/499
5,957,719 A * 9/1999 Okabe ..... 439/404
5,971,793 A * 10/1999 Jochen et al. ..... 439/405
5,971,794 A * 10/1999 Holzle ..... 439/405
6,012,943 A * 1/2000 Wu ..... 439/404
6,033,238 A * 3/2000 Fogg et al. ..... 439/108
6,059,601 A * 5/2000 Hirai et al. ..... 439/405
6,062,896 A * 5/2000 Huang ..... 439/405
6,062,907 A * 5/2000 Tan et al. ..... 439/610
6,077,105 A * 6/2000 Jochen et al. ..... 439/497
6,098,284 A * 8/2000 Price ..... 29/861
6,120,319 A * 9/2000 Lee et al. ..... 439/497
6,142,821 A * 11/2000 Hwang ..... 439/459
6,171,134 B1 * 1/2001 Lai ..... 439/405
6,174,195 B1 * 1/2001 Yang ..... 439/497
6,179,645 B1 * 1/2001 Huang ..... 439/405
6,193,541 B1 * 2/2001 Lee ..... 439/405
6,203,359 B1 * 3/2001 Lee ..... 439/405
6,206,722 B1 * 3/2001 Ko et al. ..... 439/417
6,210,205 B1 * 4/2001 Huang ..... 439/405
6,273,745 B1 * 8/2001 Yeh ..... 439/404
6,280,242 B1 * 8/2001 Jochen et al. ..... 439/497
6,368,148 B1 * 4/2002 Fogg et al. ..... 439/497
6,533,607 B2 * 3/2003 Jochen et al. ..... 439/497
6,638,100 B2 * 10/2003 Fogg et al. ..... 439/497
6,641,426 B2 * 11/2003 Saitoh ..... 439/395
6,645,002 B1 * 11/2003 Lee ..... 439/497
6,666,706 B1 * 12/2003 Jones et al. ..... 439/405
6,676,444 B2 * 1/2004 Noro ..... 439/579
6,705,893 B1 * 3/2004 Ko ..... 439/607
6,793,527 B2 * 9/2004 Noro ..... 439/579
6,840,792 B1 * 1/2005 Kuan ..... 439/404
6,884,107 B1 * 4/2005 Kuan ..... 439/404

* cited by examiner

*Primary Examiner*—Ross Gushi
(74) *Attorney, Agent, or Firm*—Troxell Law Office, PLLC

(57) ABSTRACT

A connector for connecting with cables and mate with a plug connector includes a first housing and a second housing assembled to each other, and a plurality of conductive terminals received in the first housing. The first housing has a first insulator and a first shell shielding the first insulator. The second housing has a second insulator and a second shell shielding the second insulator. Each conductive terminal has a contact end and a pierce end. When the first housing and the second housing are assembled together, the pierce ends of the conductive terminals stick ends of the cables for electrically connecting with the cables, meanwhile, by the U-shaped anchors of the first shell and the pressing protrusions of the second shell to sandwich and press against the cables. Thus, the cables are prevented from coming off or disengaging from the connector in order to keep a stable communication performance and extend the available life.

10 Claims, 5 Drawing Sheets

CONNECTOR

BACKGROUND OF THE INVENTION

1. Field of the Invention

The present invention relates to a connector, and particularly to a connector which firmly connects with cables and mates with a plug connector, by which is able to extend the available life and provide for a reliable communication performance.

2. Related Art

A conventional connector, which is adapted to be assembled to cables and mate with a plug connector, comprises an insulative housing having a connecting portion and a mating portion, a plurality of conductive terminals received between the connecting portion and the mating portion and a shell shielding the insulative housing. Accordingly one end of the cables is able to connect with the conductive terminals by said connecting portion, and by means of said mating portion enables the conductive terminals to mate with the terminals of the plug connector for the electrically communication.

The conductive terminals of the conventional connector are usually soldered to the cables. However, the cables are required to move frequently to mate with other devices, correspondingly the soldered portions of the cables tend to disengage from the conductive terminals of the conventional connector, not only resulting in unreliable communication but shortened the available life.

SUMMARY OF THE INVENTION

Accordingly, an object of the present invention is to provide a connector which firmly connects with cables and do not disengage from the cables in order to keep a stable communication performance and extend the available life.

A feature of the present invention is that the connector comprises a first housing and a second housing assembled to each other. The first housing has a first insulator and a first shell shielding the first insulator. The first insulator has a plurality of passageways therein for receiving conductive terminals and an opening adjoins the long side of said passageways for receiving a second insulator of said second housing. Latching grooves are oppositely arranged nearby the short side of said passageways for matching the second insulator of said second housing. A plurality of U-shaped anchors are longitudinally aligned spaced parallel with each other on the first shell and are positioned relatively to said passageways for sandwiching the cables that have pierced by the conductive terminals.

The second housing includes a second insulator received in the opening, and a second shell shielding the second insulator. A plurality of pressing protrusions are longitudinally aligned spaced parallel with each other on the second shell and are positioned relatively to each U-shaped anchors for pressing the cables in order to firmly fix the cables.

The above, and other objects, features and advantages of the present invention will become apparent from the following description taken in connection with the accompanying drawings.

DESCRIPTION OF THE PREFERRED EMBODIMENTS

Figure 1:
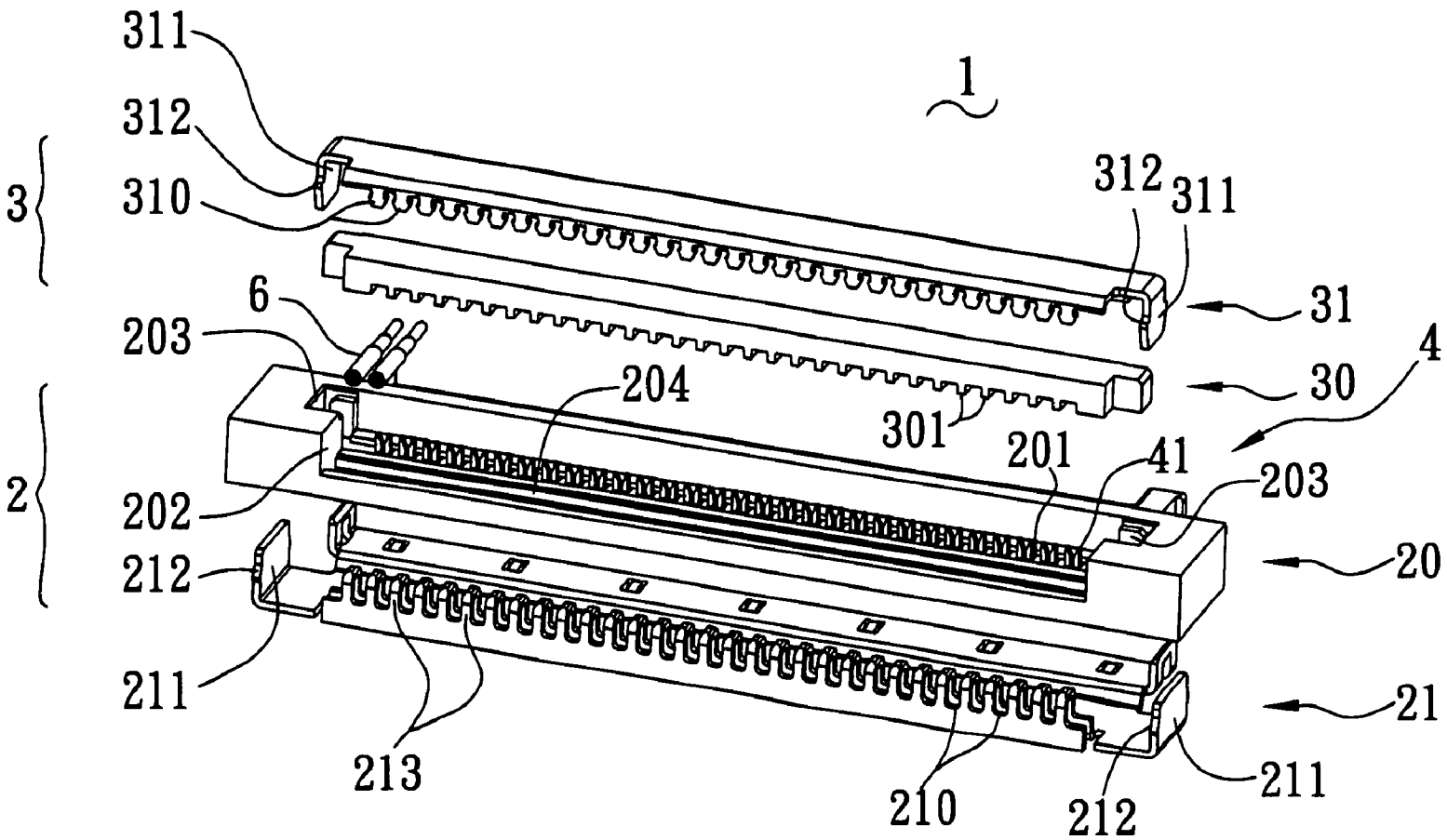
FIG. 1 is an exploded view of a connector in accordance with the present invention.
Figure 3:
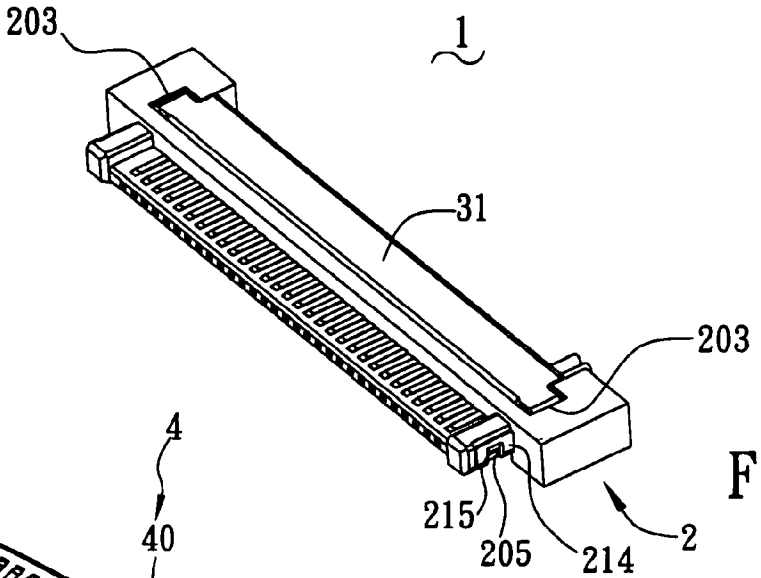
FIG. 3 is an assembled view of the connector of FIG. 2 rotating 180 degree.
Figure 2:
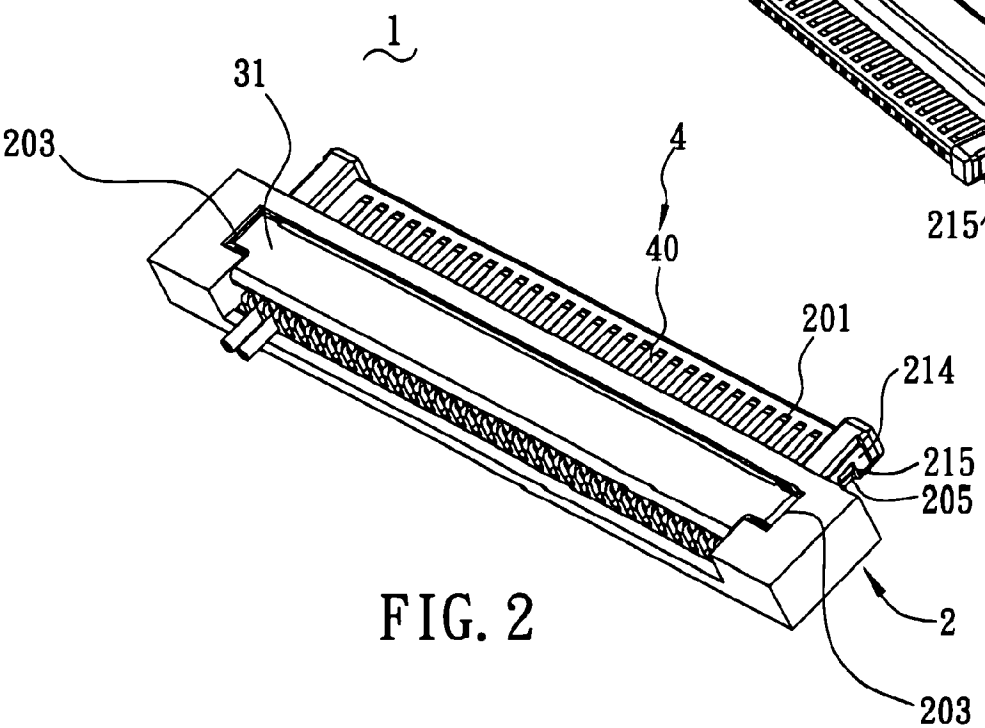
FIG. 2 is an assembled view of the connector of FIG. 1.
Figure 4:
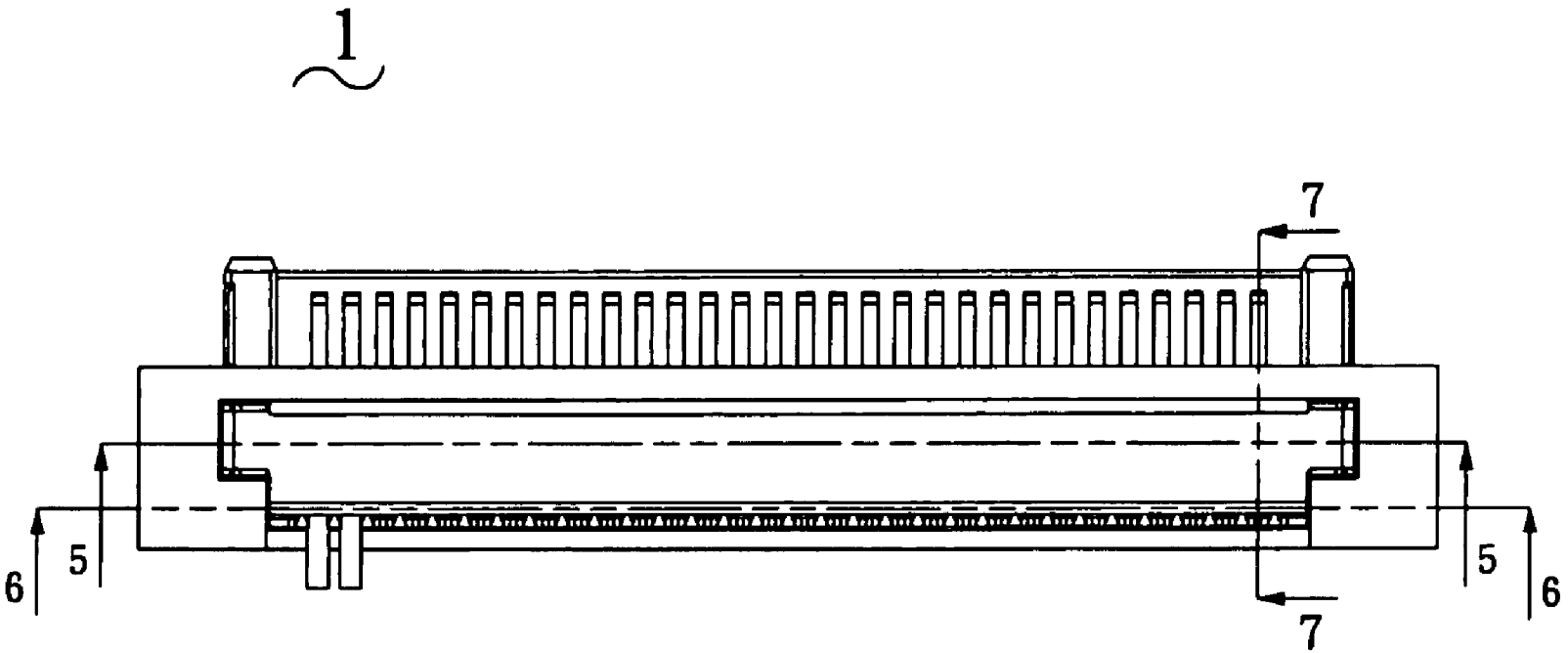
FIG. 4 is a top view of the connector of FIG. 2.

With reference to FIGS. 1 to 4, a connector 1 of the present invention comprises a first housing 2 and a second housing 3 assembled to each other.

The first housing 2 includes a first insulator 20 and a first shell 21 shielding the first insulator 20 wherein the first insulator 20 is flat and rectangular, and a plurality of passageways 201 are longitudinally arranged spaced parallel with each other on the long side of said first insulator 20 for receiving conductive terminals 4. Each conductive terminal 4 includes a contact end 40 for mating with a plug connector and a V-shaped pierce end 41 positioned in an opening 202 of said first insulator 20, the opening 202 adjoins the long side of said passageways 201 for receiving a second insulator 30 of said second housing 3, in which a slot 204 is defined to go through said first insulator 20 and communicates with the opening 202 to provide an inserted space for providing a plurality of anchors 213 passing through. Latching grooves 203 are oppositely positioned nearby the short side of said passageways 201 for matching the second insulator 30 of said second housing 3. The first shell 21 has connecting arms 211 respectively extending and bending from opposite ends thereof, in which the first barbs 212 are formed oppositely at the lateral edges of said connecting arms 211 for interferentially engaging with the first insulator 20. The anchors 213 are longitudinally aligned spaced parallel with each other between the connecting arms 211, that is, extend from the lateral edge of the first shell 21 and bend to form a U-shape for each anchor. A cavity 210 is formed on the bending plane of the U-shaped anchors 213, wherein the diameter of the cavity 210 is slightly smaller than the thickness of the pressing protrusions 310 of the second shell 3. The conjoint surfaces 214 are formed next to said connecting arms 211 of the first shell 21, in which a plurality of conjoint holes 215 are positioned thereon for relatively engaging with the protrusions 205 of the first insulator 20.

The second housing 3 includes a second insulator 30 and a second shell 31 shielding the second insulator 30, wherein the second insulator 30 has a long edge and short flanges respectively arranged at the opposite ends thereof, wherein the long edge has a plurality of biasing projections 301 longitudinally aligned spaced parallel with each other and relatively to said U-shaped anchors 213 for pressing the cables 6. A plurality of pressing protrusions 310 are defined in the second shell 31 and are longitudinally formed relatively to each of the U-shaped anchors 213 for firmly connecting with the cavity 210 of the U-shaped anchors 213. The second shell 31 has assembling arms 311 respectively extending and bending from opposite sides thereof, wherein the second barbs 312 are formed at opposite edges thereof for interferentially engaging with the latching grooves 203 of the first insulator 20.

Figure 5:
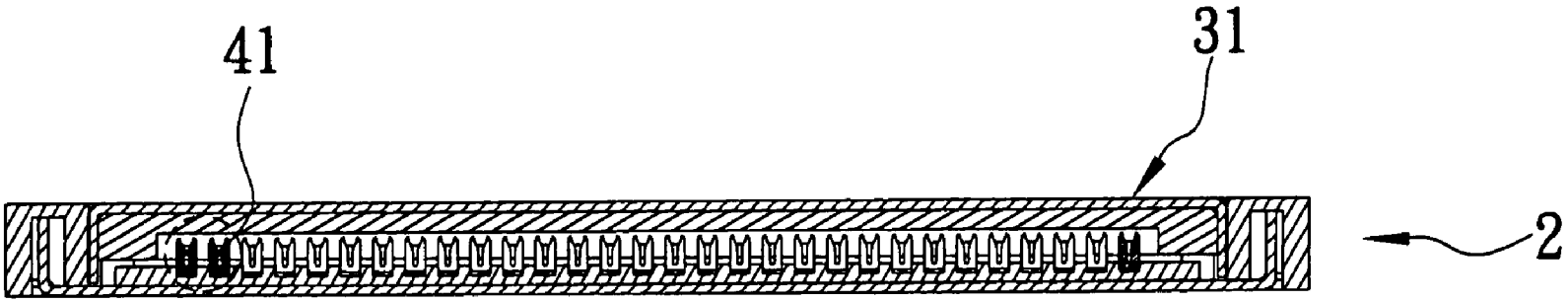
FIG. 5 is a cross-sectional view taken along the line 5—5 in FIG. 4.
Figure 6:
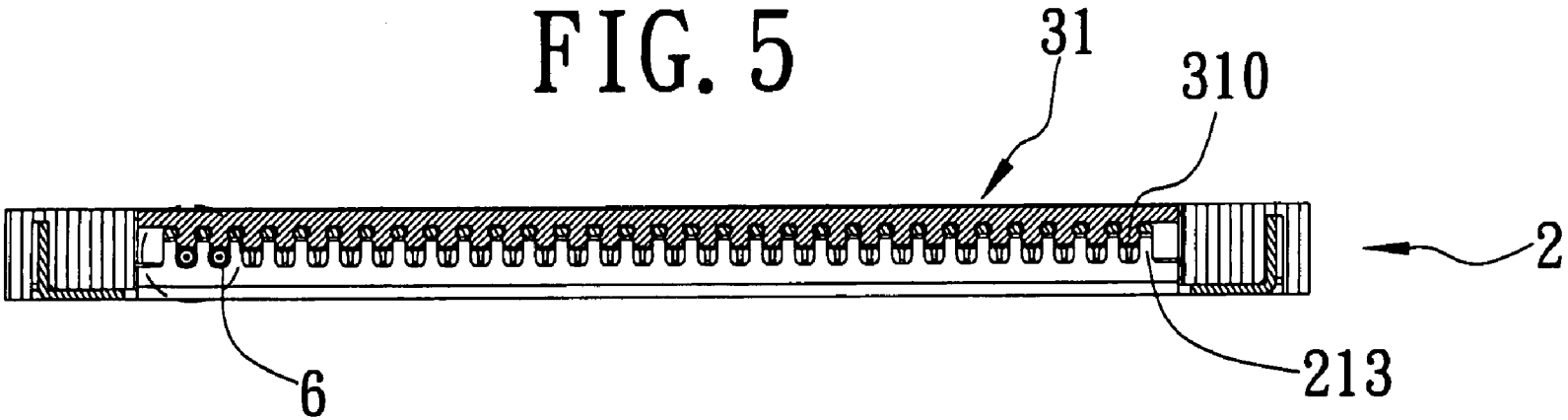
FIG. 6 is a cross-sectional view taken along the line 6—6 in FIG. 4.
Figure 7:
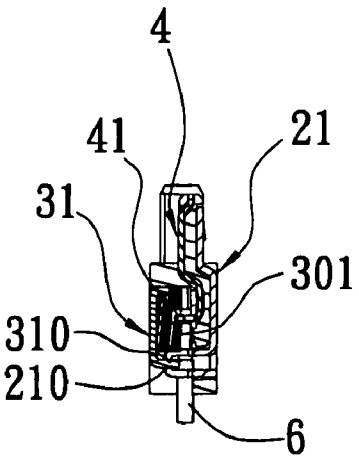
FIG. 7 is a cross-sectional view taken along the line 7—7 in FIG. 4.
Figure 6A:
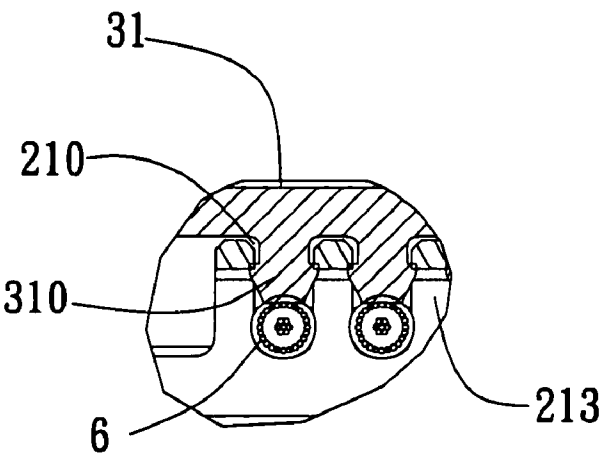
FIG. 6A is a partially enlarged view of FIG. 6.
Figure 5A:
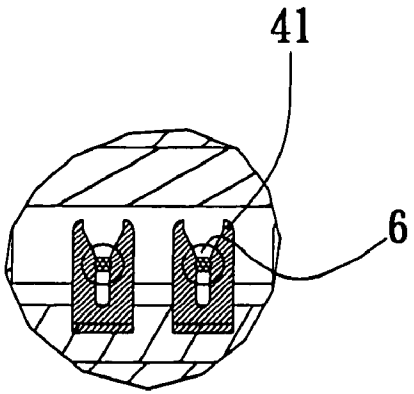
FIG. 5A is a partially enlarged view of FIG. 5.

In assembly, while assembling the first housing 2 and the second housing 3, firstly, assemble the first shell 21 to the first insulator 20 for the U-shaped anchors 213 going through the slot 204 than arrange one end of the cables 6 on the pierce ends 41 to be able to sandwich by the U-shaped anchors 213. Secondly, after assembling the second insulator 30 with the second shell 31, engage the assembling arms 311 with the latching grooves 203 of the first insulator 20(showed as FIG. 3) for enabling the pressing protrusions 310 of the second shell 31 to go through the cavity 210 of the U-shaped anchors 213 to press each of the cables 6 (showed as FIG. 6, FIG. 6A) furthermore, the cables 6 are pressed by the biasing projections 301 as well. Each of the cables 6 are pierced by the pierce ends 41 as soon as the cables 6 are being press downwardly to the pierce ends 41, which is causing the cables 6 being electrically communicating with the conductive terminals 4. In combination with FIGS. 5 and 6 and further referring to FIG. 7, obviously to see the cables 6 are sandwiched by the U-shaped anchors 213 and the pressing protrusions 310 press against the cables 6, moreover, at the same time, the biasing projections 301 further to press against the cables 6, thus, the pierced ends of the cables 6 are firmly retained in the connector 1 and effectively prevent from disengaging from the connector 1 when the cables 6 mate with other devices.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A connector, which is adapted to connect with cables and mate with a plug connector, comprising:

a first housing, including a first insulator and a first shell for shielding the first insulator, the first insulator being flat and rectangular and defining a plurality of passageways arranged on a long side thereof, an opening being defined adjoined the long side of said passageways, wherein a slot is defined to go through said first insulator and communicates with said opening, latching grooves being respectively defined oppositely positioned nearby the short side of said passageways, connecting arms respectively extending and bending from opposite sides of the first shell, A plurality of anchors are longitudinally aligned spaced parallel with each other between the connecting arms and positioned relatively to said passageways, which are able to go through said slot;

a second housing, including a second insulator received in said opening and a second shell shielding the second insulator, wherein the second insulator has a long edge and short flanges which are respectively arranged at the opposite ends thereof, and a plurality of pressing protrusions are defined in the second shell and are longitudinally formed relatively to each of said U-shaped anchors of said first shell, furthermore, assembling arms being defined respectively extending and bending from opposite sides of the second shell, and a plurality of conductive terminals, respectively received in said passageways, and each conductive terminal has a contact end for mating with a plug connector and a V-shaped pierce end for piercing an end of a cable to electrically communicate with said cable.

2. The connector as claimed in claim 1, wherein a plurality of biasing projections longitudinally aligned spaced parallel with each other and relatively to said U-shaped anchors for pressing the cables.

3. The connector as claimed in claim 1, wherein the pierce ends of said conductive terminals are V-shaped.

4. The connector as claimed in claim 1, wherein the plurality of anchors are defined extending from the lateral edge of the first shell and bend to form a U-shape for each anchor.

5. The connector as claimed in claim 4, wherein a cavity is formed on the bending plane of said U-shaped anchors.

6. The connector as claimed in claim 5, a plurality of pressing protrusions are defined in the second shell and longitudinally formed relatively to each of the U-shaped anchors for firmly connecting with the cavity of the U-shaped anchors.

7. The connector as claimed in claim 1, wherein the connecting arms of said first shell are respectively extending and bending from opposite ends of said first shell, in which the first barbs are formed oppositely at the lateral edges of said connecting arms.

8. The connector as claimed in claim 7, wherein the diameter of the cavity is slightly smaller than the thickness of said pressing protrusions of said second shell.

9. The connector as claimed in claim 1, where in the conjoint surfaces are formed next to said connecting arms of the first shell, in which a plurality of conjoint holes are positioned thereon for relatively engaging with the protrusions of the first insulator.

10. The connector as claimed in claim 9, wherein the assembling arms are respectively extending and bending from opposite sides of said second shell, furthermore, the second barbs are formed at opposite edges thereof for interferentially engaging with the latching grooves of the first insulator.

* * * * *